United States Patent [19]

Pollard

[11] Patent Number: 4,607,402

[45] Date of Patent: Aug. 26, 1986

[54] RETAINER SHEET

[76] Inventor: Dianne J. Pollard, 105 Bishop Ct., Novato, Calif. 94947

[21] Appl. No.: 723,109

[22] Filed: Apr. 15, 1985

[51] Int. Cl.[4] ..... A47C 21/08

[52] U.S. Cl. ..... 5/425; 5/485

[58] Field of Search ..... 5/485, 482, 425, 424, 5/427, 474, 452

[56] References Cited

U.S. PATENT DOCUMENTS

| | | | |
|---|---|---|---|
| 429,894 | 6/1890 | Doremus | 5/485 |
| 1,343,881 | 6/1920 | Christensen | 5/485 |
| 2,217,819 | 10/1940 | Rook et al. | 5/485 |
| 2,462,780 | 2/1949 | Schiller | 5/485 |
| 2,586,031 | 2/1952 | Hamne . | |
| 2,644,173 | 7/1953 | James | 5/425 |
| 3,148,388 | 9/1964 | Espersen . | |
| 3,638,251 | 2/1972 | Weiss . | |
| 3,924,282 | 12/1975 | Bond | 5/431 |
| 4,064,576 | 12/1977 | Threatt . | |
| 4,286,344 | 9/1981 | Ikeda | 5/424 |
| 4,334,331 | 6/1982 | Santo | 5/452 |

FOREIGN PATENT DOCUMENTS

| | | | |
|---|---|---|---|
| 868320 | 5/1961 | United Kingdom | 5/427 |
| 927094 | 5/1963 | United Kingdom . | |

*Primary Examiner*—Alexander Grosz

*Attorney, Agent, or Firm*—Flehr, Hohbach, Test, Albritton & Herbert

[57] ABSTRACT

A retainer sheet includes an array of pockets in which cylindrically shaped foam members are removably inserted to define a retainer structure enclosing a sleeping area. The foam units an be removed for laundering and can be positioned in abutting relationship to form a self-locking configuration.

5 Claims, 4 Drawing Figures

RETAINER SHEET

BACKGROUND OF THE INVENTION

The present invention relates to bed restraints and, in particular, to a removable restraint which is incoporated into a bed covering or sheet rather than into the bed frame or mattress.

Permanently mounted or removable rail or bar restraints are widely used to prevent children or the incapacitated from falling out of bed. Restraints for children's beds are available in several forms. These include longitudinal sidebars which are part of or are permanently mounted to the bed frame itself. Children's restraints also include rails which are mounted on uprights so that each rail assembly can be removably mounted or clamped on the bed frame or inserted between the frame and the mattress. Restraints for the incapacitated are typified by hospital beds which incorporate metal side rails that can be pivoted to a horizontal or down position to permit getting into and out of bed and to facilitate changing bed clothes and administering to the patient.

A second type of bed restraint is one in which the restraint is incorporated into the mattress itself. As described in Ikeda, U.S. Pat. No. 4,286,344, issued Sept. 1, 1981, the mattress construction includes an integral, multiple layer, semi-circular longitudinal and/or transverse elastomeric ridges or air bladders (FIG. 8 of Ikeda) which function to prevent a user from falling off the sides of the mattress. The elastomeric ridges can be formed integrally with the mattress (FIGS. 1, 2) or formed as separate C-shaped, self-clamping structures (FIG. 9). This mattress restraint quite apparently requires the use of non-standard, custom-fitted sheets. In addition, the mattress restraint and the various frame restraints described above involve relatively complicated structures and manufacturing processes, are not readily interchangeable between beds and, in the case of frame mounted restraints, are permanently attached to the frame.

SUMMARY OF THE INVENTION

In view of the above discussion, it is one object of the present invention to provide a bed restraint which is easily removed from the bed and, when placed on the bed permits ease of access to the occupant of the bed, as well as ease of ingress and egress.

It is another object of the present invention to provide a bed restraint which is not dedicated to a particular bed or structure, but rather is readily adaptable to, and transferable between, different beds.

It is also an object of the present invention to provide a bed restraint which not only is readily transferable between beds, but also is suitable for children as well as adults.

These and other objects are attained in my bed restraint invention which, in one aspect, comprises a bed covering or sheet containing elongated pods or pockets along one or more of the sides, head and foot, which receive removable cylindrical inserts of a relatively rigid material such as polystyrene foam cylinders.

In another aspect of the invention the pods and inserts are configured in an overlapping, self-locking arrangement in which the inserts abut one another and thereby cooperatively retain one another in position.

BRIEF DESCRIPTION OF THE DRAWINGS

The above and other aspects of the invention are described in conjunction with the drawings in which.

DETAIL DESCRIPTION OF THE INVENTION

Figure 1:
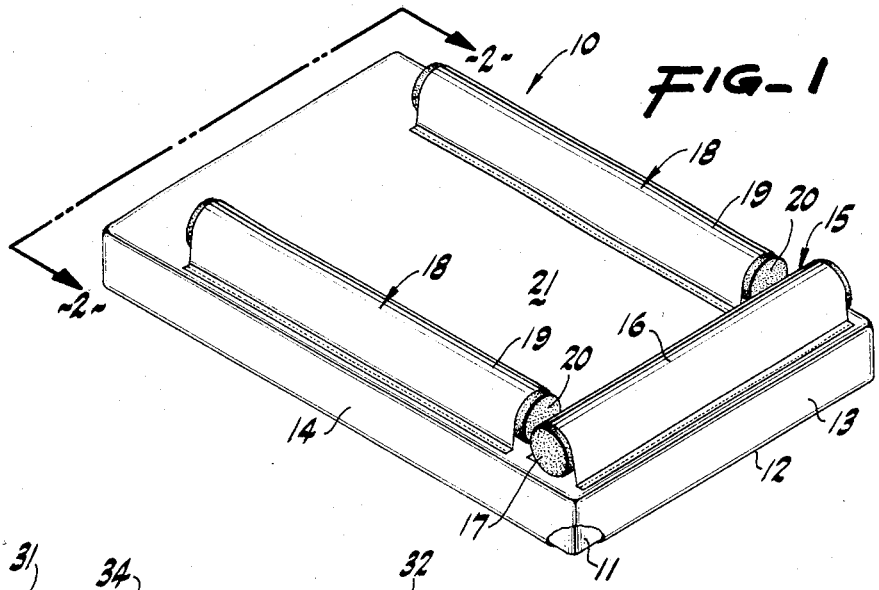
FIG. 1 is a perspective view of my fitted retainer sheet in position on a bed.

FIG. 1 is a schematic perspective representation of one embodiment 10 of the retainer sheet of my present invention fitted to a mattress 11. The illustrated embodiment includes a fitted sheet 12, but is quite obviously adaptable to non-fitted sheets as well. The fitted sheet 12 includes end panels 13 and side panels 14 which are designed to closely fit the associated contours of the mattress 11. Typically the sheet 12 includes an elastic border or hem on the end and side panels (not shown) which retains the sheet on the mattress 11.

Figure 2:
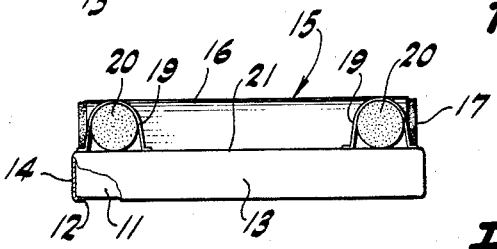
FIG. 2 is an end view of the retainer sheet of FIG. 1 looking in the direction of arrows 2—2.

At one end and along two sides of the sheet 12 are pod assemblies or retainers 15 and 18. The retainers are formed by pockets which are dimensioned to receive cylindrical components or inserts of relatively rigid plastic resin such as polystyrene foam or similar material. In particular, the retainers form a U-shaped configuration in which the base of the U is formed by a pod assembly 15 comprising pocket 16 and associated cylindrical insert 17 at the head of the mattress. The sides of the U configuration are defined by longitudinally extending pod assemblies 18—18 which comprise pockets 19—19 and their associated inserts 20—20. See also FIG. 2. The pocket structures 15 and 18 thus define an enclosed U-shaped resting or sleeping area 21.

Alternatively, a fourth pocket and foam insert can be employed at the head or at the foot of the mattress to provide a totally enclosed sleeping or resting area. Also, two side retainers 18—18 can be used without head or foot retainers.

My retainer sheet has a number of advantages over conventional bar, rail and mattress retainers. For example, the cylindrical foam units 17 and 20 can be removed to permit laundering but, when in place, provide soft but firm barriers which retain the occupant on the mattress. The retainer sheet 10 can be formed in the various standard sheet sizes and used interchangeably on different mattresses or beds. Also, the same retainer sheet 10 can be used both in situations which require a bed or mattress restraint to prevent someone who is ill or otherwise incapacitated from falling off the bed, as well as to retain a child in bed once the child has moved from a crib to a regular bed.

Figure 3:
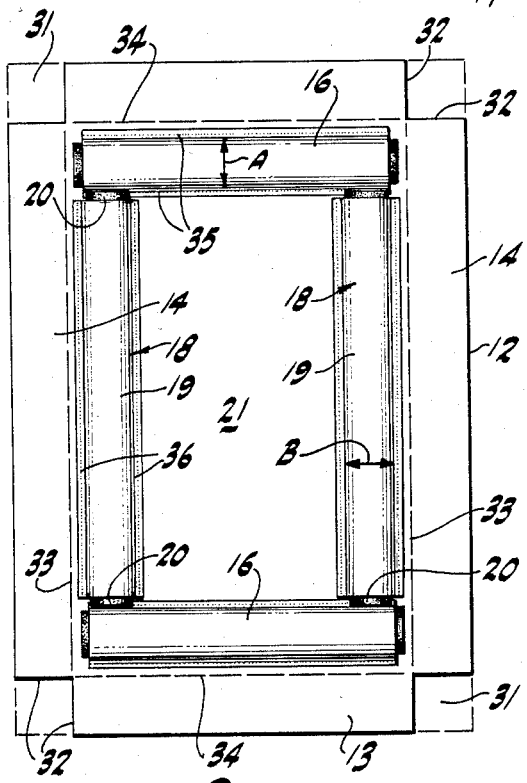
FIG. 3 is a plan view of the sheet and retainer pod structure of FIG. 1.

A plan view of the retainer sheet 10 is shown in FIG. 3. The sheet comprises a rectangle of cloth or other material and includes end panels 13—13 and side panels 14—14. In the fitted embodiment, the sheet typically has sections such as 31—31 removed and is joined along the ends 32—32 to provide a shape which conforms to the contour of the mattress 11 (FIG. 1). The side pods or retainers 18—18 extend at or adjacent the longitudinal edges 33—33 of the top side 21 of the sheet. Similarly, the head and foot pods or retainers 15—15 (also termed end pods) extend generally at or adjacent the end edges 34—34 of the sheet. Preferably, in an easily manufacturable approach, the pockets 16 and 19 are rectangular strips of material which are attached to the sheet 12 by sewing. The lines of stitching join the pockets to the sheet along the long outer edges of the pocket material, as illustrated schematically by the stitch lines 35—35 and 36—36 in FIG. 3. However, other means of attachment, hook and loop type fasteners, such as the ones sold under the trademark Velcro, and water-resistant, releasable adhesive can be used. The actual width of the rectangular strips of pocket material is greater than the distances A and B between the stitch lines 35—35 and 36—36 to accommodate the cylindrical inserts 17 and 20 (FIG. 1). Also, while the circular insert cross-section is a preferred shape for user comfort, uniformity and ease of insertion, other shapes can be used as well. As one example, polygonal cross-section inserts can be used instead of the circular cross-section cylinder inserts.

Friction between the relatively long side pockets 19 and end pockets 16 and their associated inserts has proven sufficient to retain the inserts in the pockets. Nonetheless, the retainers can be readily configured and located to provide a self-locking arrangement where such is desired. Thus, referring further to FIG. 3, in the illustrated, totally enclosed four sided restraint structure, the inner sides of the opposite ends of the end pods 15—15 abut or are closely adjacent to the ends of the side pods 18—18. Typically the cylindrical side foam units 20 are inserted first, then the end components are inserted. The side inserts 20 slightly overlap the end pods 15. As a result, the end pods 15 block the side inserts 20 and thereby prevent the side inserts from moving. In addition, the side inserts 20 press against the end pods 15 slightly and prevent the end inserts 17 from moving.

It should be noted that this self-locking arrangement is not limited to totally enclosed four-sided configuration. For example, the three-sided, U-shaped retainer configuration shown in FIG. 1 can be located and sized as described for the four-sided arrangement of FIG. 3 and the ends of the pockets 19 at the head of the mattress can be closed to effect a three-sided self-locking structure. Quite obviously, one end of the end pocket 16 can be closed as well.

Figure 4:
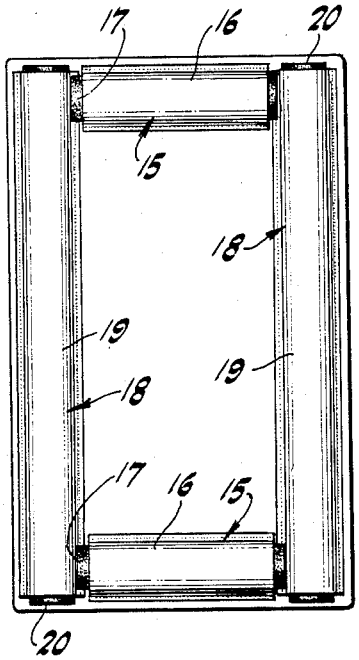
FIG. 4 is a schematic representation of an alternative self-locking pod arrangement.

In another self-locking arrangement, shown schematically in FIG. 4, the side pods 18 overlap the end pods 15. This arrangement is functionally the reverse of the overlapping end pod arrangement shown in FIGS. 1 and 3. That is, in the FIG. 4 arrangement, the side pods 18 block the end inserts 17, while, in pressing against the side pods, the end inserts prevent the side inserts 20 from moving.

In one working example of the embodiment 10 of FIG. 1, the fitted retainer sheet 10 was based upon a standard twin-size fitted sheet 12. The cloth rectangles for the side pockets 19—19 each measured $12\frac{1}{4}'' \times 41''$ and the cloth rectangle for the overlapping end pocket 16 measured $12\frac{1}{4}'' \times 38''$. All three cloth pockets were attached to the sheet 12 by sewing, leaving 6 inches between the stitch lines (dimensions A and B, FIG. 3). The 6 inch distance between the stitch lines and the $12\frac{1}{4}''$ width of the pocket material were chosen to smoothly accommodate the five inch diameter high density injected polystyrene foam inserts 17 and 20. The end inserts 17 and the side inserts 20 were, respectively, 36 inches long and 42 inches long. The resulting side pods 18 were spaced $23\frac{1}{4}''$ between the inner stitch lines, thereby providing an ample sleeping area 21 for a child and locating the side pods in abutting relationship to the end pod 15 to provide an enclosed, U-shaped sleeping area defined by self-locking retainers.

Although various embodiments of my retainer sheet have been described here, those of usual skill in the art will derive other embodiments, based upon the present disclosure, which are within the scope of the invention as claimed.

Having thus described various working and alternative embodiments, what is claimed is:

1. A retainer sheet for covering the top surface of a base such as a mattress and for preventing a person or object resting on the mattress from falling off, the retainer sheet comprising:

a sheet of flexible material;

a plurality of elongated retainers attached to the peripheral area of the sheet in the region thereof corresponding to the top surface of the base and defining a generally U-shaped restraint about a rest area of the sheet, a first one of the retainers forming the base of the U-shaped restraint for providing a foot or head restraint and the second and third ones of the retainers forming the sides of the U-shaped restraint for providing restraints along the length of the sheet and mattress;

each retainer comprising a relatively narrow elongated strip of flexible material which is attached to the base sheet along the length of the strip to thereby define a pocket, and a relatively rigid cylinder of plastic resin material sized for removable insertion into the associated pocket; and the combination of the sheet material, the resin material and the relative cross-sectional area of the cylinder and of the pockets providing friction between the cylinder and the pocket material which permits insertion and removal of the cylinder into the pocket yet retains the cylinder when in the pocket.

2. The retainer sheet of claim 1 further comprising a fourth retainer enclosing the U-shaped restraint for defining a substantially enclosed rest area.

3. The retainer sheet of claim 1 wherein each end of the side retainers abuts the adjacent base retainer.

4. A retainer sheet for covering the top surface of a base such as a mattress and for preventing a person or object resting on the mattress from falling off, the retainer sheet comprising:

a sheet of flexible material;

four elongated retainers attached to the peripheral area of the sheet in the region thereof corresponding to the top surface of the base for forming a generally rectangular shaped restraint about a rest area of the sheet, a first pair of the retainers forming the ends of the restraint along the foot and head of the sheet and mattress, and a second pair of the retainers forming the sides of the restraint along the longitudinal sides of the sheet and mattress;

each retainer comprising a relatively narrow elongated strip of flexible material which is attached to the base sheet along the length of the strip to thereby define a pocket, and a relatively rigid cylinder of plastic resin material sized for removable insertion into the associated pocket; and wherein each end of the side retainers or the end retainers abuts the nearest end of the adjacent end retainer or side retainer for retaining the end and side cylinders within their respective pockets.

5. The retainer sheet of claim 4 wherein each end of the end retainers abuts the adjacent side retainer.

* * * * *